United States Patent [19]

Fukuyama

[11] 4,089,413

[45] May 16, 1978

[54] NEEDLE CONTAINER

[76] Inventor: Katsuhiko Fukuyama, Midorii 3099, Sato-cho, Hiroshima-shi, Hiroshima, Japan

[21] Appl. No.: 771,299

[22] Filed: Feb. 23, 1977

[51] Int. Cl.[2] ..... B65D 85/24

[52] U.S. Cl. ..... 206/382; 220/23.86; 220/351; 217/62; 206/459

[58] Field of Search ..... 206/380, 381, 382, 383, 206/45.34, 459; 220/23.83, 23.86, 351, 345; 217/62

[56] References Cited

U.S. PATENT DOCUMENTS

| | | | |
|---|---|---|---|
| 1,495,186 | 5/1924 | La Rue | 206/381 |
| 2,831,572 | 4/1958 | Messina | 206/382 |
| 3,194,237 | 7/1965 | Rubin | 206/380 |
| 3,406,821 | 10/1968 | Weissberg | 206/45.34 |
| 3,444,995 | 5/1969 | Sanders | 206/382 |
| 3,530,978 | 9/1970 | Lewandowski | 206/45.34 |
| 3,604,556 | 9/1971 | Schwartz | 206/45.34 |
| 3,648,831 | 3/1972 | Arnone | 206/45.34 |
| 3,917,106 | 11/1975 | Bargetzi | 220/23.83 |
| 3,951,263 | 4/1976 | Vale | 206/382 |
| 3,982,631 | 9/1976 | Kunik et al. | 206/380 |

FOREIGN PATENT DOCUMENTS

| | | | |
|---|---|---|---|
| 957,333 | 11/1974 | Canada | 206/380 |
| 710,590 | 9/1941 | Germany | 220/351 |

*Primary Examiner*—Stephen P. Garbe
*Assistant Examiner*—Joseph Man-Fu Moy
*Attorney, Agent, or Firm*—Frank J. Jordan

[57] ABSTRACT

A needle container comprises a container body and a lid engageable thereon by means of a dovetail joint. The container body includes a needle holder separately mounted on a holder retainer so that the needle holder itself is interchangeable according to the kind and number of needles to be accommodated.

13 Claims, 9 Drawing Figures

NEEDLE CONTAINER

BACKGROUND OF THE INVENTION

This invention relates to a sewing needle container having a needle holder constituting a part of the container body and which can be replaced with other needle holders according to the kinds and numbers of sewing needles to be held.

Conventionally, known sewing needle containers consist substantially of a container body, including a sewing needle holder, and a lid means which are assembled by means of a tenon-and-mortise joint with the lid acting as a mortise and sliding lengthwise along and over the container which acts as a tenon so as to open or close the container. Such conventional sewing needle containers, however, incorporate the sewing needle holder as an integral or inseparable part thereof. Therefore, when it is desired that the holder accommodate needles of a different kind or different number, the entire container must be replaced with a new container provided with a new holder since the holder is not separable from the container as described above.

This advantage of conventional needle containers results in that containers of various kinds and sizes must be made in order to accommodate various kinds of needles, resulting in high production costs.

Accordingly, it is an object of the present invention to provide a needle container which overcomes the aforementioned disadvantages whereby the new needle container can hold needles properly in place regardless of the kind or number of needles to be accommodated by merely replacing the holder, which is separably assembled, in the container.

It is another object of the present invention to provide a needle container which can be displayed in a display case in various forms according to its three basic parts; for instance: the needle holder alone, the needle holder together with the holder retainer, and the needle holder along with the holder retainer together with the lid.

DETAILED DESCRIPTION OF THE PREFERRED EMBODIMENTS

Figure 1:
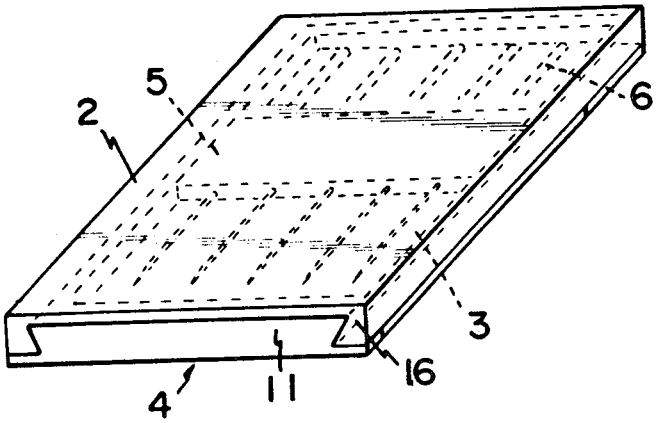
FIG. 1 is an overall perspective view of a needle container according to one embodiment of the invention.
Figure 2:
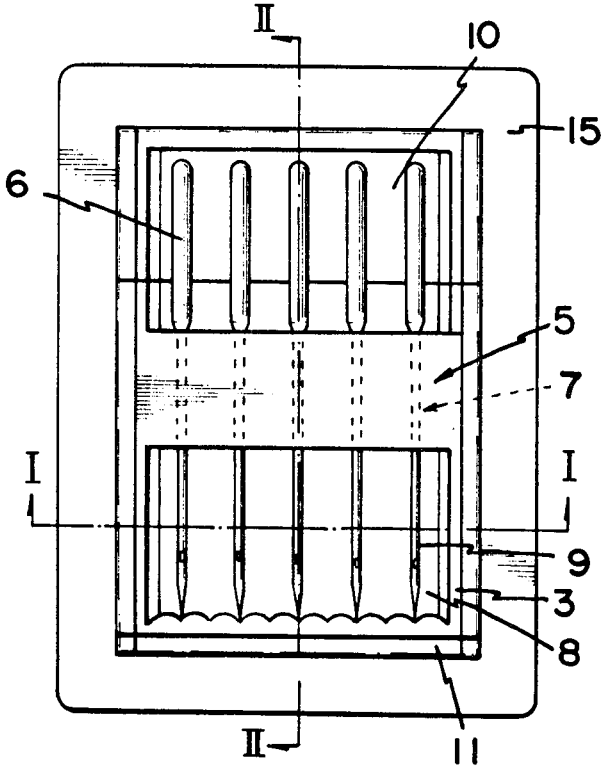
FIG. 2 is a plan view of the above needle container shown in FIG. 1
Figure 4:
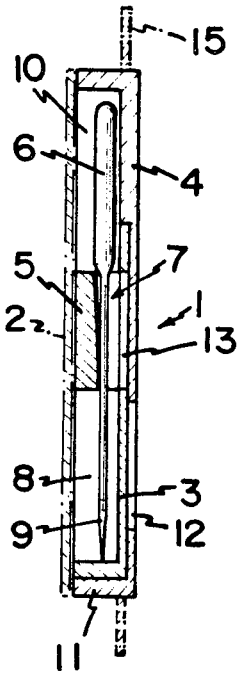
FIG. 4 is a longitudinal cross-sectional view taken along the line II—II of FIG. 2.
Figure 3:
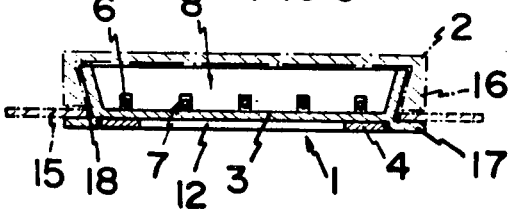
FIG. 3 is a transverse cross-sectional view taken along the line I—I of FIG. 2
Figure 5:
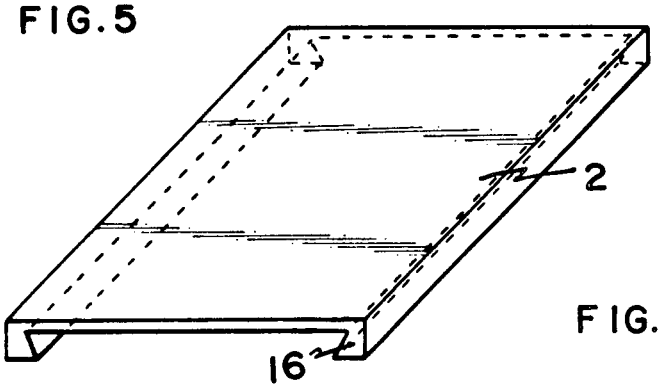
FIG. 5 is a perspective view of the sliding lid of the needle container.
Figure 6:
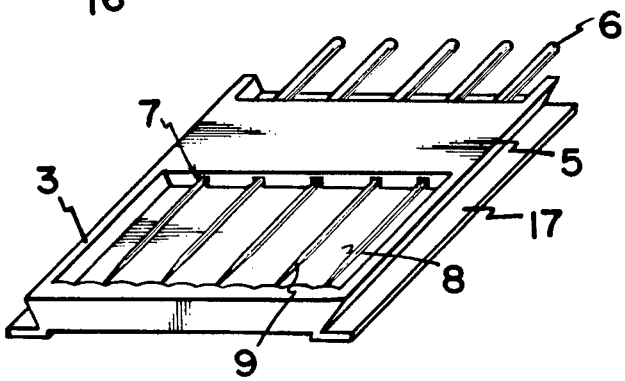
FIG. 6 is a perspective view of the needle holder.
Figure 7:
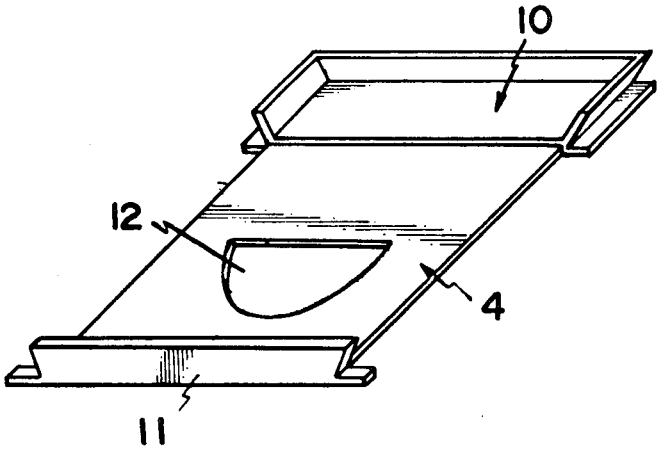
FIG. 7 is a perspective view of the holder retainer.
Figure 8:
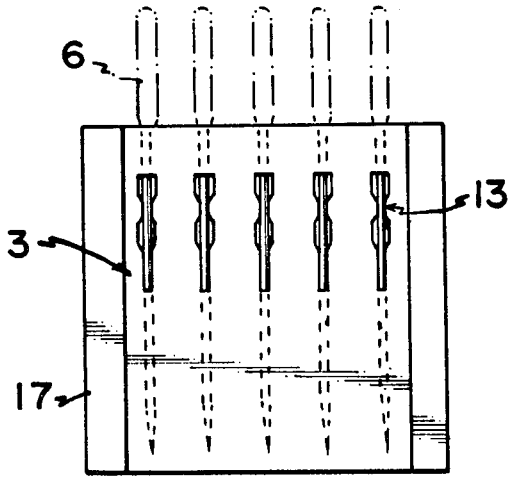
FIG. 8 is a bottom plan view of the needle holder.
Figure 9:
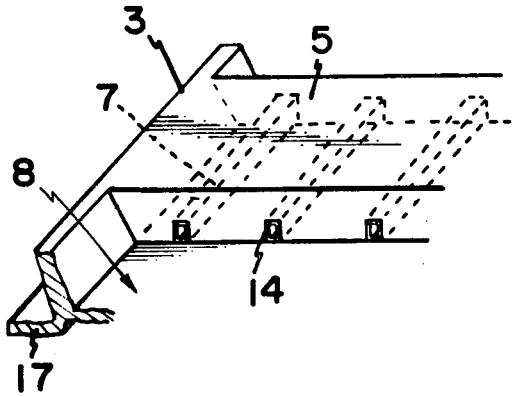
FIG. 9 is an enlarged perspective and partial view of the needle holder showing the needle receiving apertures in detail.

Referring to the drawings, there is shown in FIG. 1 through FIG. 4 a container body 1 and a sliding lid 2 engaged with each other in a dovetail arrangement such that the sliding lid 2 is slidable along and over the container body 1 to open or close the container.

The container body 1 comprises a needle holder 3 which holds a desired number and size of needles 6 properly in place and a holder retainer 4 on which the needle holder 3 is separably mounted.

The holder 3 comprises a needle mounting portion 5 which is provided with parallel and spaced apertures 7 which receive the needles 6 and a needle shaft display recess 8 adjacent to the needle mounting portion 5.

The needle receiving apertures 7 snugly hold the desired number of needles 6, such as sewing needles, while the display recess 8 shows that the needles 6 are accommodated neatly and properly in the holder 3.

The holder retainer 4 comprises a recess 10 to hold the shanks of the needles at one end of the retainer 4, and numeral 11 indicates an upright guide plate at the other end of the retainer 4 to facilitate mounting the holder 3 on top of and within the holder retainer 4. An opening 12 in the central flat portion of the holder retainer 4 facilitates the sliding movement of the sliding lid 2 relative to the container body 1 by permitting the user to press his fingertips there against.

Needle fixing guides 13 at the mid-portion of the needle receiving apertures 7 snugly hold the central portion of the needles 6 in place. A film means 14 at the periphery of one end of the apertures 7 is provided to obtain the same effect as that of the above needle fixing guide 13.

Furthermore, the above needle container can be provided with a cardboard or other type mounting member 15 on which desired indications can be printed such as a trademark and the kind and number or size of the needles. This mounting member 15 can be sandwiched and held between the sliding lid 2 and the needle container body 1. Thus an inner peripheral edge of an opening 18 in the mounting member 15 is sandwiched between the side portions 16 of the sliding lid 2 and the lateral and horizontal extensions 17 of the needle holder 3. Needle fixing guide 13 comprises spaced projections extending into the apertures 7 and which engage the needles to support the latter in the apertures 7. Film means 14 are made of plastic and usually are casting fins produced at the time of die casting the needle holders. These fin-like films snugly hold the needles by the elasticity thereof.

The manner in which the needle container of this invention is assembled and displayed will now be described. The needle holder 3 which holds a desired number of needles 6 is mounted on the holder retainer 4. Subsequently the mounting member 15 on which the desired indications are printed is disposed over the needle holder 3 such that the inner peripheral edge of the mounting member 15 is in contact with the horizontal extensions 17. Finally, the sliding lid 2 is engaged and slid into position on the needle holder 3 along the dovetail joint, thus completing the assembly of the needle container while sandwiching the above mounting member 15 between the sliding lid 2 and the needle holder 3.

The sliding lid 2 is made preferably of transparent synthetic material, such as plastic, so that the particulars of the accommodated needles can be seen at a glance.

As has been described heretofore, the needle container of this invention has the following advantages:

(1) Since the needle holder 3 is separable from the holder retainer 4, various kinds of needles as well as various numbers of needles can be accommodated in the same needle container by merely replacing the needle holder with another needle holder containing the appropriate number or kinds of needles desired, thereby reducing the cost of producing the needle container.

(2) The mounting member on which the desired indications, such as a trademark, is printed can be sandwiched easily and precisely between the needle holder 3 and the sliding lid 2.

(3) Since there is an opening in the central flat portion of the holder retainer 4, the opening or closing movement of the sliding lid 2 relative to the container body can be facilitated by pressing with one's fingertip.

(4) Since the needle receiving apertures 7 are provided with fixing guides as well as thin films, the sewing needles can be held snugly within the above apertures.

What is claimed is:

1. A needle retainer comprising a needle holder for holding needles, a needle holder retainer on which said needle holder is seaprably mounted, said needle holder having inclined side wall portions, said needle holder retainer having inclined side wall portions comprising a first wall section and a second wall section, said first wall section being spaced from said second wall section, said needle holder and said needle holder retainer having their respective side wall portions aligned to form a continuous side wall when the needle holder is placed in said needle holder retainer with said inclined side wall portions of said needle holder disposed in said space between said first and second wall sections, a sliding lid having a top portion and downwardly depending side sections which have inclined inner side walls, said sliding lid being engageably and slidably mounted on said needle holder and said needle holder retainer such that said continuous side wall mates with said inclined inner wall of said sliding lid to define a dovetail joint, whereby said sliding lid secures said needle holder and needle holder retainer in assembled condition.

2. A needle container according to claim 1, wherein said needle holder is provided with spaced apart and parallel needle receiving apertures.

3. A needle container according to claim 2, wherein said needle holder comprises a needle mounting portion which is provided with said needle receiving apertures and means defining a needle shaft display recess adjacent to said needle receiving portion.

4. A needle container according to claim 3, wherein one end of said needle receiving apertures is adapted to the shaft portion of said needle and the other end snugly holds the central portion of said needle.

5. A needle container according to claim 3, wherein said needle receiving apertures have needle fixing guides at the mid-sections thereof.

6. A needle container according to claim 3 wherein said needle receiving apertures are provided with film means at one end thereof.

7. A needle container according to claim 3 wherein a mounting member on which a desired indication such as a trademark is printed is sandwiched between said needle holder and said sliding lid.

8. A needle container according to claim 1 wherein said needle holder retainer is provided with means defining an opening at a central flat portion thereof for facilitating the sliding movement of said sliding lid relative to said container body.

9. A needle container according to claim 3 wherein said needle mounting portion engages said sliding lid when the latter is in assembled condition.

10. A needle container according to claim 1 wherein said needle holder and said needle holder retainer have side flanges extending from the respective inclined side wall portions, said side flanges of said needle holder and said needle holder retainer being aligned and forming a continuous flange when the needle holder and needle holder retainer are in assembled condition, and a mounting card means sandwiched between said continuous flange and said depending side sections of said sliding lid.

11. A needle container according to claim 1 wherein said needle holder retainer has a longitudinal length which is substantially the same as the longitudinal length of said sliding lid, said needle holder having a longitudinal length less than the longitudinal length of said needle holder.

12. A needle container according to claim 1 wherein said needle holder retainer is provided with an upright guide plate and said needle holder is provided with a recess to facilitate mounting said needle holder on said needle holder retainer.

13. A needle container according to claim 1 wherein said needle holder retainer has a recess at one longitudinal end thereof to accommodate end portions of said needles.

* * * * *